US006872145B1

(12) United States Patent
Boudreaux et al.

(10) Patent No.: US 6,872,145 B1
(45) Date of Patent: Mar. 29, 2005

(54) SOLO-OPERABLE SEESAW

(76) Inventors: Dale Boudreaux, 1506 Highway 304, Thibodaux, LA (US) 70301; Michael Boudreaux, 1506 Highway 304, Thibodaux, LA (US) 70301

( * ) Notice: Subject to any disclaimer, the term of this patent is extended or adjusted under 35 U.S.C. 154(b) by 0 days.

(21) Appl. No.: 10/751,322

(22) Filed: Jan. 5, 2004

(51) Int. Cl.[7] ..... A63G 11/00
(52) U.S. Cl. ..... 472/110; 472/112
(58) Field of Search ..... 472/106–115

(56) References Cited

U.S. PATENT DOCUMENTS

| | | | | | |
|---|---|---|---|---|---|
| 834,140 | A | * | 10/1906 | Kingsbury | 446/322 |
| D55,572 | S | | 2/1920 | Peterson | |
| 1,476,065 | A | * | 12/1923 | Flint | 472/115 |
| 2,509,796 | A | | 5/1950 | Bailey | |
| 2,542,359 | A | * | 2/1951 | Rocklin | 472/110 |
| 2,544,106 | A | * | 3/1951 | Ray | 472/110 |
| 2,784,968 | A | * | 3/1957 | Bakula | 472/109 |
| 2,830,815 | A | * | 4/1958 | Bruce | 472/107 |
| 2,953,376 | A | | 9/1960 | Thorton | |
| 3,968,962 | A | | 7/1976 | Atkins | |
| 4,620,843 | A | * | 11/1986 | Higginbotham et al. | 446/94 |
| 4,838,543 | A | * | 6/1989 | Armstrong et al. | 482/53 |
| 5,178,599 | A | * | 1/1993 | Scott | 482/137 |
| 5,547,425 | A | | 8/1996 | Krhs | |
| 5,776,002 | A | | 7/1998 | Weber | |
| 6,533,672 | B1 | * | 3/2003 | Keller et al. | 472/110 |

* cited by examiner

*Primary Examiner*—Kien Nguyen

(57) ABSTRACT

A solo-operable seesaw includes a base member having oppositely spaced side sections for engaging a ground surface and further includes a plurality of elongated braces having opposed end portions connected thereto. The seesaw further includes an elongated plank having a first end portion engaged with the base member and selectively pivotable thereabout. The plank further has an oppositely spaced second end portion defining a seat and includes a plurality of elongated handlebars extending outwardly from the plank. The seesaw further includes a mechanism for pivotally lifting the plank upwardly along a predetermined arcuate path after the second end portion of the plank is moved to select lowered positions. The lifting mechanism includes a spring-loaded hydraulic air piston having opposed end portions and a plurality of brackets connected thereto. The lifting mechanism-further includes an elongated swivel pin transversely passing through the plank for connecting same to the base member.

12 Claims, 2 Drawing Sheets

SOLO-OPERABLE SEESAW

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a playground apparatus and, more particularly, to a solo-operable seesaw for indoor or outdoor use.

2. Prior Art

For decades, children have spent incalculable hours of their childhood riding an apparatus commonly known as a seesaw or teeter-totter. In the early stages of its product life, such apparatuses were most commonly found on playgrounds, in city parks, schools and the like due to their size and cost. In recent years, due to the widespread adaptation of durable plastic material to playground equipment, such apparatuses have become readily available to homeowners because of their reduced cost and weight.

Despite these enhancements, however, the common seesaw still has a number of inherent features that make it less than ideal as a playground apparatus. First, because the seesaw requires two children in order to be operational, a child must always have a playmate available in order to ride the seesaw. With home seesaws, this may not always be the case because couples are having fewer children today and parents are increasingly concerned about safety when their child is away from home and out of sight. Therefore, a sibling or neighbor may not always be available to ride the seesaw. Second, because the seesaw operates on the principle of counterbalancing weights, injury can result if a rider suddenly falls or jumps off the seesaw while the opposing rider is high in the air, particularly if one rider is substantially heavier than the other. In this scenario, the opposing rider is sent crashing to the ground and the sudden impact may jar a child's joints or cause spine or tailbone injuries. Third, a seesaw plank can be a dangerous object in the hands of a mischievous child who may abruptly pull down on one end when another child is passing by the opposite end, causing the opposite end to rise quickly and potentially striking the passing child. Fourth, due to their size and the height reached by a rider, such seesaws are generally limited to outdoor use.

Because of the above shortcomings, a need remains for a playground apparatus similar to a conventional seesaw, but operable by a single user, eliminating the need to have a second rider. Second, a need also remains for a playground apparatus that is economical in cost to manufacture, lightweight, and easy to use. Third, a need remains for a playground apparatus that offers greater safety than conventional seesaws, offers hours of exciting diversion for a child, and affords an alternative to swing sets and other recreational devices. Lastly, a need remains for a portable seesaw apparatus that can be used indoors during inclement weather conditions and outdoors when weather permits.

BRIEF SUMMARY OF THE INVENTION

In view of the foregoing background, it is therefore an object of the present invention to provide an apparatus for a single child to use as a seesaw. These and other objects, features, and advantages of the invention are provided by a solo-operable seesaw movable between ground and elevated positions.

The seesaw includes a base member having oppositely spaced side sections and a back section integral therewith and spaced therebetween. The side sections have respective bottom edge portions for engaging a ground surface and further have respective top edge portions for defining an apex of the base member. The base member further includes a plurality of elongated braces having opposed end portions connected thereto for maintaining the side sections at substantially stable positions.

The seesaw further includes an elongated plank having a first end portion engaged with the base member and selectively pivotable thereabout. The plank further has an oppositely spaced second end portion defining a seat for receiving an operator thereon. The plank further has a centrally disposed longitudinal axis and includes a plurality of elongated handlebars extending outwardly from the plank and substantially laterally to the axis. The base member and the plank are preferably formed from lightweight material and have respective hollow interior portions so that the seesaw can be readily and easily transported between remote locations.

The seesaw further includes a mechanism for pivotally lifting the plank upwardly along a predetermined arcuate path after the second-end portion of the plank is moved to select lowered positions. The lifting mechanism is connected to the base member and the plank respectively and includes a spring-loaded hydraulic air piston having opposed end portions and a plurality of brackets connected thereto. Such brackets pivotally connect the piston to the seesaw so that the piston can be contemporaneously moved between a linear path and an arcuate path during operating conditions. The piston is disposed substantially medially between the side sections wherein one of the plurality of brackets is connected to one of the plurality of braces.

The lifting means further includes an elongated swivel pin transversely passing through the plank for connecting same to the base member. The swivel pin cooperates with the piston for allowing the plank to operably move along the arcuate path.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
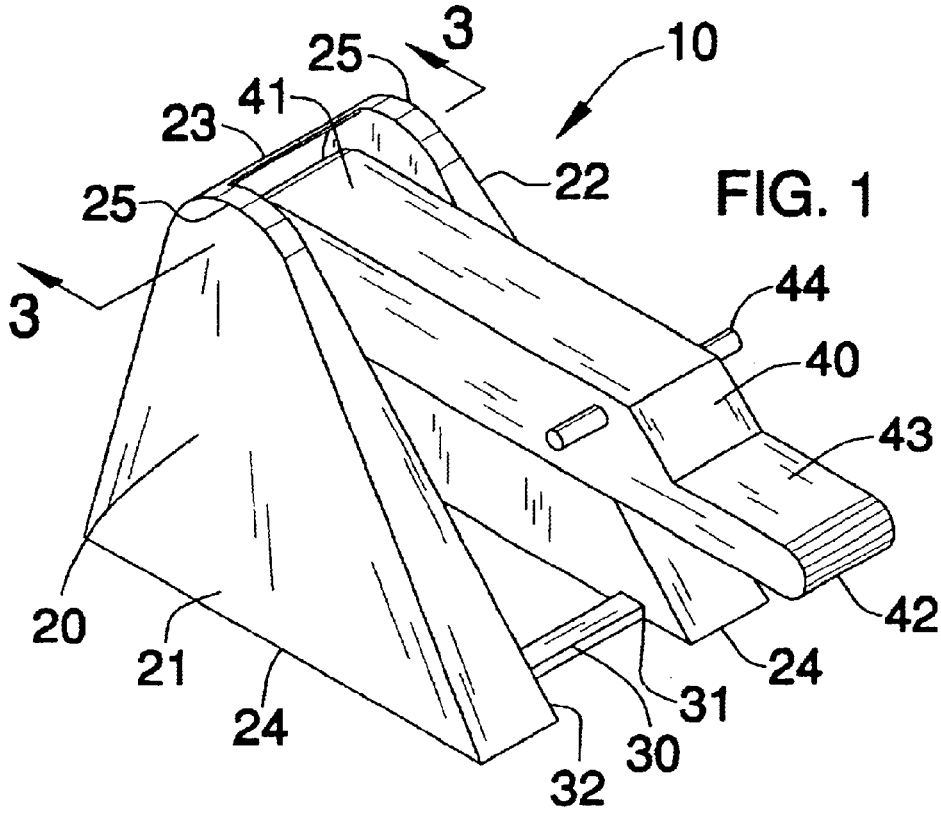
FIG. 1 is a perspective view showing a solo-operable seesaw, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1–4 by the reference numeral 10 and is intended provide a solo-operable seesaw. It should be understood that the seesaw 10 may be used for providing recreation and exercise to people of all ages and should not be limited for providing recreation and exercise to only small children.

Initially referring to FIG. 1, the seesaw 10 includes a base member 20 having oppositely spaced side sections 21, 22 and a back section 23 integral therewith and spaced therebetween. The side sections 21, 22 have respective bottom edge portions 24 for engaging a ground surface and further have respective top edge portions 25 for defining an apex of the base member 20. The base member 20 further includes a plurality of elongated braces 30 having opposed end portions 31, 32 connected thereto for maintaining the side sections 21, 22 at substantially stable positions.

The seesaw 10 further includes an elongated plank 40 having a first end portion 41 engaged with the base member 20 and selectively pivotable thereabout. The plank 40 further has an oppositely spaced second end portion 42 defining a seat 43 for receiving an operator thereon. The seat enables a user to slide easily on or off the plank 40 with little effort. The plank 40 further has a centrally disposed longitudinal axis (not shown) and includes a plurality of elongated handlebars 44 extending outwardly from the plank 40 and substantially laterally to the axis. The handlebars 40 are easily grasped by a user for assisting in maintaining a stationary position on the seat 43. The base member 20 and the plank 40 are preferably formed from lightweight, durable plastic material and have respective hollow interior portions so that the seesaw 10 can be readily and easily transported between remote locations.

Figure 2:
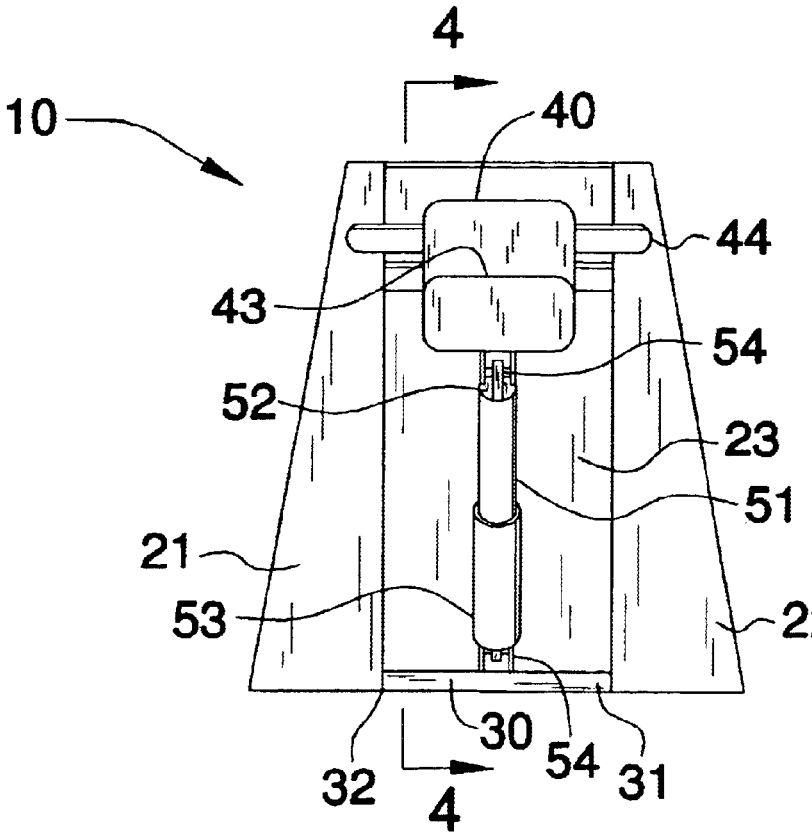
FIG. 2 is a rear elevational view of the apparatus shown in FIG. 1.
Figure 4:
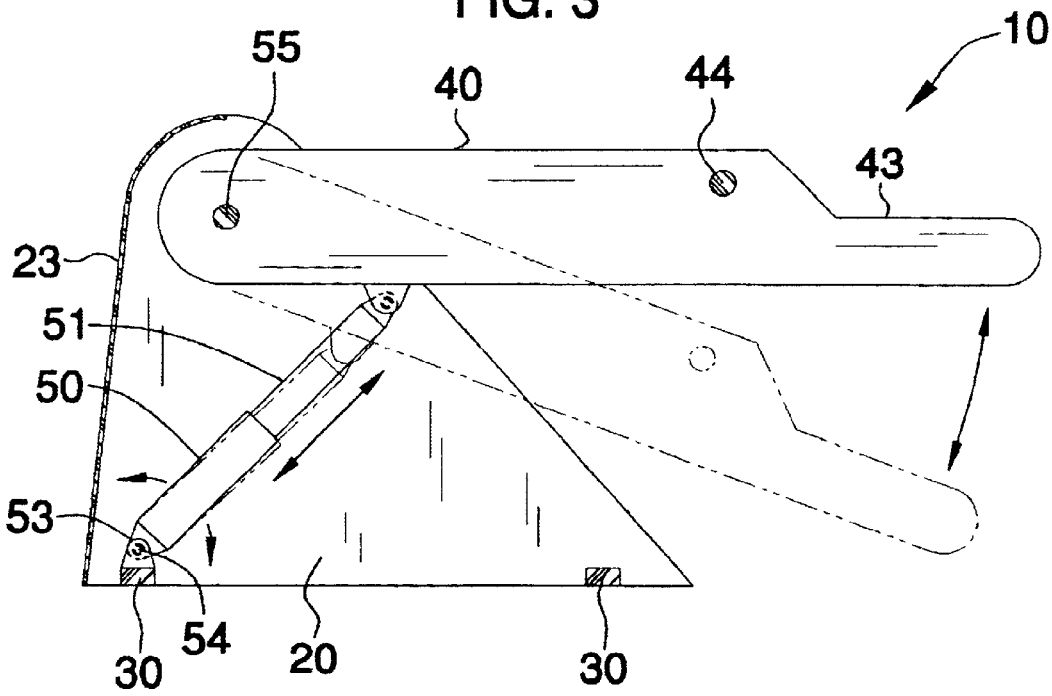
FIG. 4 is a cross-sectional view of the apparatus shown in FIG. 2, taken along line 4—4.

Now referring to FIGS. 2 and 4, the seesaw 10 further includes a mechanism 50 for pivotally lifting the plank 40 upwardly along a predetermined arcuate path after the second end portion 42 of the plank 40 is moved to select lowered positions, as best shown in FIG. 4. The lifting mechanism 50 is connected to the base member 20 and the plank 40 respectively, and includes a spring-loaded hydraulic air piston 51 having opposed end portions 52, 53 and a plurality of brackets 54 connected thereto. Such brackets 54 pivotally connect the piston 51 to the seesaw 10 so that the piston 51 can be contemporaneously moved between a linear path and an arcuate path during operating conditions.

The piston 51 controls the speed of the plank 40 and allows it to move along the predetermined arcuate path like a conventional seesaw without the need for an additional rider. To use the seesaw 10, children would sit on the seat 43, grasp the handlebars 44, and push off with their feet. The piston 51 is disposed substantially medially between the side sections 21, 22 wherein one of the plurality of brackets 54 is connected to one of the plurality of braces 30.

Figure 3:
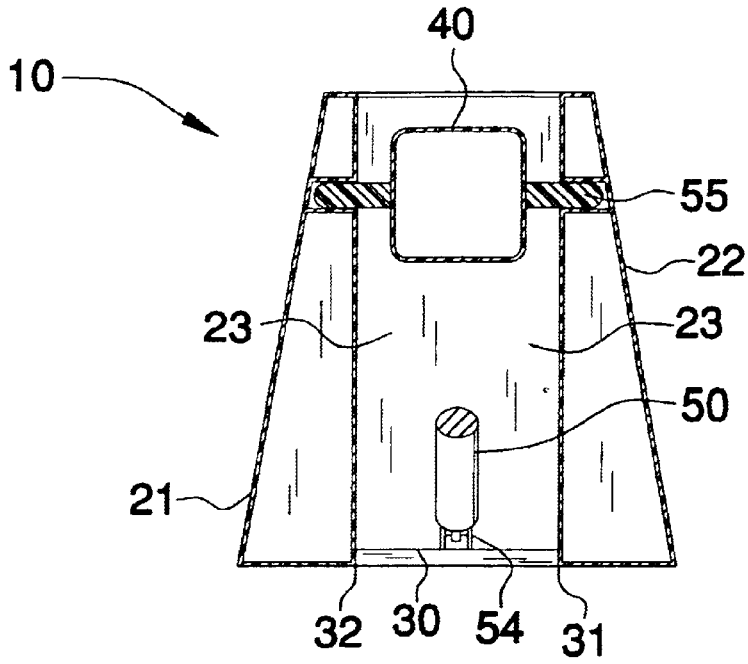
FIG. 3 is a cross-sectional view of the apparatus shown in FIG. 1, taken along line 3—3.

Now referring to FIGS. 3 and 4, the lifting mechanism 50 further includes an elongated swivel pin 55 transversely passing through the plank 40 for connecting same to the base member 20. The swivel pin 55 cooperates with the piston 51 for allowing the plank 40 to operably move along the arcuate path. The swivel pin 51 further prevents the piston 51 from disengaging from the plank 40 and causing the plank 40 to rapidly descend to a ground surface and injuring a child seated thereon.

The seesaw 10 provides a safer, portable, and single user alternative to conventional playground seesaws and may be designed to accommodate children of all ages. This enables a child to safely play alone without a parent having to worry about injuries, fights, arguments, etc., thus freeing the parent to do his own work or chores. In this fashion, children would be able to enjoy a safe and fun seesaw ride even if there is not another child with whom to seesaw. While the seesaw 10 is ideal for home use, it may also be used in parks, schools and playgrounds.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, material, shape, form, function and manner of operation. The assembly and use of the present invention are deemed readily apparent and obvious to one skilled in the art.

What is claimed as new and what is desired to secure by Letters Patent of the United States is:

1. A seesaw movable between ground and elevated positions and comprising:

a base member having oppositely spaced side sections and a back section integral therewith and spaced therebetween, said side sections having respective bottom edge portions for engaging a ground surface and further having respective top edge portions for defining an apex of said base member, said base member further including a plurality of elongated braces having opposed end portions connected thereto and for maintaining said side sections at substantially stable positions;

an elongated plank having a first end portion engaged with said base member and being selectively pivotable thereabout, said plank further having an oppositely spaced second end portion defining a seat for receiving an operator thereon; and means for pivotally lifting said plank upwardly along a predetermined arcuate path after said second end portion of said plank is moved to select lowered positions, said lifting means being connected to said base member and said plank respectively.

2. The seesaw of claim 1, wherein said plank further has a centrally disposed longitudinal axis and includes a plurality of elongated handle bars extending outwardly from the plank and substantially laterally to the axis.

3. The seesaw of claim 1, wherein said lifting means comprises:

a spring-loaded hydraulic air piston having opposed end portions and a plurality of brackets connected thereto and for pivotally connecting said piston to said seesaw so that said piston can be contemporaneously moved between a linear path and an arcuate path during operating conditions, said piston being disposed substantially medially between said side sections wherein one said plurality of brackets are connected to one said plurality of braces.

4. The seesaw of claim 3, wherein said lifting means further comprises:

an elongated swivel pin transversely passing through said plank and for connecting same to said base member, said swivel pin cooperating with said piston for allowing said plank to operably move along the arcuate path.

5. The seesaw of claim 1, wherein said base member and said plank are formed from light-weight material and have respective hollow interior portions so that said seesaw can be readily and easily transported between remote locations.

6. A seesaw movable between ground and elevated positions and comprising:

a base member having oppositely spaced side sections and a back section integral therewith and spaced therebetween, said side sections having respective bottom edge portions for engaging a ground surface and further having respective top edge portions for defining an apex of said base member, said base member further including a plurality of elongated braces having opposed end portions connected thereto and for maintaining said side sections at substantially stable positions;

an elongated plank having a first end portion engaged with said base member and being selectively pivotable thereabout, said plank further having an oppositely spaced second end portion defining a seat for receiving an operator thereon; and means for pivotally lifting said plank upwardly along a predetermined arcuate path after said second end portion of said plank is moved to select lowered positions, said lifting means being connected to said base member and said plank respectively;

said plank further having a centrally disposed longitudinal axis and including a plurality of elongated handle bars extending outwardly from the plank and substantially laterally to the axis.

7. The seesaw of claim 6, wherein said lifting means comprises:

a spring-loaded hydraulic air piston having opposed end portions and a plurality of brackets connected thereto and for pivotally connecting said piston to said seesaw so that said piston can be contemporaneously moved between a linear path and an arcuate path during operating conditions, said piston being disposed substantially medially between said side sections wherein one said plurality of brackets are connected to one said plurality of braces.

8. The seesaw of claim 7, wherein said lifting means further comprises:

an elongated swivel pin transversely passing through said plank and for connecting same to said base member, said swivel pin cooperating with said piston for allowing said plank to operably move along the arcuate path.

9. The seesaw of claim 7, wherein said base member and said plank are formed from light-weight material and have respective hollow interior portions so that said seesaw can be readily and easily transported between remote locations.

10. A seesaw movable between ground and elevated positions and comprising:

a base member having oppositely spaced side sections and a back section integral therewith and spaced therebetween, said side sections having respective bottom edge portions for engaging a ground surface and further having respective top edge portions for defining an apex of said base member, said base member further including a plurality of elongated braces having opposed end portions connected thereto and for maintaining said side sections at substantially stable positions;

an elongated plank having a first end portion engaged with said base member and being selectively pivotable thereabout, said plank further having an oppositely spaced second end portion defining a seat for receiving an operator thereon, said plank further having a centrally disposed longitudinal axis and including a plurality of elongated handle bars extending outwardly from the plank and substantially laterally to the axis; and means for pivotally lifting said plank upwardly along a predetermined arcuate path after said second end portion of said plank is moved to select lowered positions, said lifting means being connected to said base member and said plank respectively, said lifting means comprising a spring-loaded hydraulic air piston having opposed end portions and a plurality of brackets connected thereto and for pivotally connecting said piston to said seesaw so that said piston can be contemporaneously moved between a linear path and an arcuate path during operating conditions, said piston being disposed substantially medially between said side sections wherein one said plurality of brackets are connected to one said plurality of braces.

11. The seesaw of claim 10, wherein said lifting means further comprises:

an elongated swivel pin transversely passing through said plank and for connecting same to said base member, said swivel pin cooperating with said piston for allowing said plank to operably move along the arcuate path.

12. The seesaw of claim 10, wherein said base member and said plank are formed from light-weight material and have respective hollow interior portions so that said seesaw can be readily and easily transported between remote locations.

* * * * *